US011041297B2

(12) United States Patent
Zarraonandia

(10) Patent No.: US 11,041,297 B2
(45) Date of Patent: Jun. 22, 2021

(54) WATER MANAGEMENT SYSTEM AND METHODS

(71) Applicant: Pre-Con Products, Simi Valley, CA (US)

(72) Inventor: David Zarraonandia, Thousand Oaks, CA (US)

(73) Assignee: PRE-CON PRODUCTS, Simi Valley, CA (US)

( * ) Notice: Subject to any disclaimer, the term of this patent is extended or adjusted under 35 U.S.C. 154(b) by 0 days.

(21) Appl. No.: 16/685,817

(22) Filed: Nov. 15, 2019

(65) Prior Publication Data

US 2021/0148105 A1 May 20, 2021

(51) Int. Cl.

| | |
|---|---|
| ***B65G 5/00*** | (2006.01) |
| ***E02B 11/00*** | (2006.01) |
| ***E03F 1/00*** | (2006.01) |

(52) U.S. Cl.

CPC ..... *E03F 1/005* (2013.01)

(58) Field of Classification Search

CPC ... E03F 1/00; E03F 1/001; E03F 1/002; E03F 1/003; E03F 1/004; E03F 1/005; E03F 1/006; E03F 1/007; E03F 1/008; B65G 5/00; B65G 5/005; E02B 11/00; E02B 11/005

USPC ..... 210/170.01, 170.03, 170.07, 170.08; 405/36, 43, 50, 52, 53, 55

See application file for complete search history.

(56) References Cited

U.S. PATENT DOCUMENTS 1,958,487 A * 5/1934 Moran ..... B65D 88/76 405/55
3,106,824 A * 10/1963 Gregory ..... F17C 3/005 405/55
3,215,087 A * 11/1965 McLeod, Jr. ..... E21B 43/122 417/55
3,234,745 A * 2/1966 Johnson ..... F17C 13/04 62/48.1
3,507,120 A * 4/1970 Rohmer ..... B65D 88/76 405/53
3,522,842 A * 8/1970 New ..... E21B 43/2401 166/52
3,661,294 A * 5/1972 Pearson ..... B65D 90/029 220/645
3,680,496 A * 8/1972 Westlake, Jr. ..... B29C 66/21 108/57.26
3,726,095 A * 4/1973 Ross ..... E02D 3/115 405/130
3,745,738 A * 7/1973 Singer ..... E02D 29/124 52/741.3

(Continued)

*Primary Examiner* — Edwin J Toledo-Duran
(74) *Attorney, Agent, or Firm* — Thompson Coburn LLP

(57) ABSTRACT

Water management systems and methods of constructing water management systems comprising two-dimensional arrays of cells. Each cell has a base and a cell top module stacked on the base, the cell top module having a top flange and at least one top leg, a lower end of which engages the base. A base of one system has a bottom leg with an upper end cavity configured for a lateral clearance fit of a lower end portion of the top leg. The cavity holds at least one stacked spacer and is filled with a flowable substance after the top leg is inserted and positioned on the spacer. The flowable substance hardens to fully seat the lower end portion of the upper leg. Another system series of the cell top flanges being held together by tension cables extending therethrough.

20 Claims, 9 Drawing Sheets

(56) References Cited

U.S. PATENT DOCUMENTS 3,824,933 A * 7/1974 Lind ..... B29C 66/1312 108/56.1
3,861,102 A * 1/1975 Hodge ..... E04B 2/66 52/236.3
3,868,915 A * 3/1975 Hafner ..... B65D 19/0012 108/57.26
4,359,167 A * 11/1982 Fouss ..... B65D 88/76 220/675
4,516,878 A * 5/1985 Rebhan ..... E02D 19/14 405/130
4,718,208 A * 1/1988 Fons ..... E04H 7/30 220/565
4,934,404 A * 6/1990 DeStefano ..... E03B 3/03 137/357
5,282,546 A * 2/1994 Bauer ..... B65D 90/028 220/560.03
5,333,465 A * 8/1994 McBride ..... F17C 1/007 137/264
5,341,877 A * 8/1994 Abdul ..... B09C 1/002 166/272.1
5,386,669 A * 2/1995 Almeida ..... E02D 29/12 220/560.01
5,482,404 A * 1/1996 Tenbusch, II ..... E21B 7/20 405/184
5,495,695 A * 3/1996 Elliott, Jr. ..... B65D 88/76 220/565
5,553,971 A * 9/1996 Osborne ..... B67D 7/04 405/52
5,564,588 A * 10/1996 Reese ..... B60S 5/02 220/565
5,651,848 A * 7/1997 Cohee ..... A42B 3/06 156/93
5,799,817 A * 9/1998 Sharp ..... B65D 90/507 220/567.1
5,803,304 A * 9/1998 Berg ..... B65D 88/06 220/565
5,806,702 A * 9/1998 Sabo ..... E03F 11/00 220/4.12
5,879,110 A * 3/1999 Carter, Jr. ..... B09B 1/00 405/129.5
5,969,242 A * 10/1999 Hubbell ..... E21B 47/06 73/152.51
6,039,201 A * 3/2000 Kesterman ..... B67D 7/3209 141/86
6,227,396 B1 * 5/2001 Small ..... B65D 88/022 220/4.12
6,694,672 B1 * 2/2004 Hergeth ..... E01C 13/083 47/65.9
D556,293 S * 11/2007 Daley ..... E03F 5/02 D23/203
7,624,892 B2 * 12/2009 Daley ..... E03F 5/02 220/565
8,016,030 B1 * 9/2011 Prado Garcia ..... E21B 43/0122 166/75.13
8,091,728 B2 * 1/2012 Burwell ..... E03B 3/03 220/565
8,132,771 B2 * 3/2012 Lee ..... B61D 45/00 248/346.02
9,303,365 B2 * 4/2016 Gooden ..... E01C 5/001
9,506,235 B2 * 11/2016 Adams ..... E03F 3/046
9,708,806 B2 * 7/2017 Meincke ..... E03F 1/00
9,896,832 B2 * 2/2018 Graf ..... E03F 1/005
9,957,987 B2 * 5/2018 Wandkowski ..... E03F 1/00
10,132,069 B2 * 11/2018 Van Der Scheer ..... E03F 1/005
2003/0188505 A1 * 10/2003 Marshall ..... E03F 1/005 52/606
2005/0155285 A1 * 7/2005 Urban ..... E03F 1/005 47/32.7
2007/0181197 A1 * 8/2007 Krichten ..... E03F 1/005 137/833
2007/0267418 A1 * 11/2007 Takai ..... E03B 3/03 220/567.1
2007/0274776 A1 * 11/2007 Urriola ..... E01C 9/004 403/364
2008/0044231 A1 * 2/2008 Roelfsema ..... E02B 11/00 405/129.57
2008/0166182 A1 * 7/2008 Smith ..... E03F 1/005 405/36
2009/0250369 A1 * 10/2009 Guibert ..... E03F 1/002 206/507
2010/0200600 A1 * 8/2010 Hoekstra ..... E03F 1/005 220/676
2011/0108559 A1 * 5/2011 Hewing ..... E02B 11/005 220/694
2011/0200390 A1 * 8/2011 Rodriguez ..... E02D 29/0241 405/38
2012/0141203 A1 * 6/2012 Gooden ..... E01C 9/004 404/41
2012/0255624 A1 * 10/2012 Canney ..... E02B 11/005 137/315.01
2013/0248000 A1 * 9/2013 Killeen ..... F17D 3/00 137/14
2013/0284750 A1 * 10/2013 Takai ..... E03F 1/002 220/565
2014/0291221 A1 * 10/2014 Adams ..... E03F 3/046 210/170.03
2014/0346099 A1 * 11/2014 Brantley ..... E03B 3/02 210/127
2014/0369757 A1 * 12/2014 Meincke ..... E03F 1/005 405/36
2015/0017384 A1 * 1/2015 Wichmann ..... E03F 5/0401 428/118
2016/0265209 A1 * 9/2016 Graf ..... E03F 1/005
2017/0087607 A1 * 3/2017 Carey ..... F28F 27/00
2017/0186503 A1 * 6/2017 Wattenburg ..... G21C 15/182
2017/0292259 A1 * 10/2017 Van Der Scheer ..... E03F 1/002
2017/0292260 A1 * 10/2017 Van Der Scheer ... E02B 11/005
2017/0335648 A1 * 11/2017 Al-Badran ..... E21B 33/02
2018/0030712 A1 * 2/2018 Kent ..... F17C 3/005
2020/0011048 A1 * 1/2020 Kent ..... E03F 1/005

* cited by examiner

WATER MANAGEMENT SYSTEM AND METHODS

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to water management systems adapted to take in, and more slowly drain, an influx of water, such as from a storm.

SUMMARY

One aspect of the present disclosure is a water management system comprising a plurality of cells having a top flange, a bottom flange, and side openings, the side openings comprised in a peripheral cell area extending from an outer perimeter of the top flange to an outer perimeter of the bottom flange. Each cell is positioned adjacent a side opening of at least one adjacent cell, to permit water to flow laterally through the side opening from either of the adjacent cells to the other adjacent cell. Each cell includes a top module and a bottom module, the top module comprising the top flange and at least one top leg integral to the top flange, a plan area of the top leg being disposed entirely within a plan area of the top flange. The top leg has a vertical longitudinal axis and extends perpendicularly from the top flange to a top leg lower end portion, the top leg lower end portion having an outer peripheral surface and an end surface. The top leg lower end portion may be a narrower projection extending downwardly from a wider portion of the top leg with an annular end face that surrounds the narrower projection. The bottom module comprises the bottom flange and at least one bottom leg integral to the bottom flange, a plan area of the bottom leg being disposed entirely within a plan area of the bottom flange. The bottom leg has a vertical longitudinal axis that extends from the bottom flange to a bottom leg end portion, the bottom leg end portion having a bottom leg sidewall and a recessed end surface forming a bottom leg cavity. The bottom leg cavity has a closed bottom defined by the recessed bottom leg end surface, a closed periphery defined by an inner surface of the bottom leg sidewall, and an open top surrounded by a rim of the bottom leg sidewall. The bottom leg cavity is operative to fit the top leg lower end portion inserted in a centered position therein with a clearance, which may be a lateral clearance in all horizontal directions, between the inner surface of the bottom leg sidewall and the outer peripheral surface of the top leg lower end portion. At least one spacer is disposed within the bottom leg cavity, to adjust for vertical construction tolerance. In an embodiment, the top leg lower end portion is a downward projection from a wider portion of the top leg and has a height approximately equal to a vertical depth of the cavity, the wider portion of the top leg being wider than the cavity, such that a (combined) height of the at least one spacer defines the height of a vertical clearance between the wider portion of the top leg and the rim of the bottom leg sidewall. The top leg lower end portion is at least partially inserted into the bottom leg cavity and positioned on the at least one spacer so that the at least one spacer is clamped between the top leg lower end surface and the bottom leg recessed end surface, at least a part of the outer peripheral surface of the top leg lower end portion being separated from the inner surface of the bottom leg sidewall by a clearance, which may be a lateral clearance in all horizontal directions. A flowable substance in a hardened state occupies at least a portion of the clearance to seat the top leg lower end portion within the clearance, the hardened flowable substance having an exposed top surface.

One or both of the top module and the bottom module may be cast from concrete and may be a monolithic casting of concrete. One or both of the top module and the bottom module may be cast in a single casting.

In an embodiment, the bottom leg sidewall rim comprises an upwardly facing flat surface of the bottom leg sidewall that defines an opening coinciding with the open top of the bottom leg cavity. The hardened flowable substance, which may be grout, has a flat surface that is flush with the flat surface of the bottom leg sidewall rim. Preferably, the flat surface of the flowable substance that is flush with the flat surface of the bottom leg sidewall does not abut any part of the top leg.

Another aspect of the present disclosure is a method of constructing a water management system according to the preceding aspect. The method includes positioning the cell bottom modules in an array so that the bottom flange plan areas are in tessellated alignment; positioning at least one spacer on the bottom leg recessed end surface so that the at least one spacer is disposed entirely below the open top of the cavity; positioning a cell top module on each cell bottom module in the cell bottom module array by inserting each top leg lower end portion into the respective bottom leg cavity in a centered position with a clearance between the inner surface of the bottom leg sidewall and the outer peripheral surface of the top leg lower end portion; horizontally adjusting the top leg lower end portions within the bottom leg cavities so that the top flange plan areas are in tessellated alignment in a manner such that the cells comprise side openings, wherein the side openings are comprised in a peripheral cell area extending vertically from the bottom flange perimeter to the top flange perimeter, and in a manner such that each of the cells is positioned adjacent a side opening of at least one other of cells, to permit water to flow laterally through the side opening from either of the adjacent cells to the other adjacent cell. When each top leg lower end portion is so inserted into and horizontally positioned within the respective bottom leg cavity such that the at least one spacer is disposed between the top leg lower end surface and the bottom leg recessed end surface, a balance of each cavity is at least partially filled with a flowable substance. In an embodiment the flowable substance is filled to a level no higher than the open top of the cavity, and preferably to a level approximately aligned with the open top of the cavity. The flowable substance is caused to harden, such as by leaving the flowable substance in the cavity for a hardening time, to seat the inserted and horizontally positioned top leg lower end portion in the cavity.

In an embodiment, the method further includes, before positioning a cell top module on each cell bottom module, mounting an alignment guide on the bottom leg. The alignment guide comprises a peripheral collar, the peripheral collar extending around and engaging an outer peripheral surface of the bottom leg to support the alignment guide when the alignment guide is mounted on the bottom leg, and at least one guide member operatively connected to and tapering upwardly and outwardly from the peripheral collar. For example, the at least one guide member may comprise a plurality of elongate prongs spaced apart about a perimeter of the peripheral collar by small enough distances to restrict the top leg to an area surrounded by the elongate prongs once the top leg is partially inserted into the area surrounded by the elongate prongs. An upper end of the at least one guide member defines an insertion area configured for insertion of an outer peripheral portion of the top leg downwardly therethrough. The alignment guide is adapted and configured such that, when the alignment guide is mounted on the bottom leg, the insertion area is spaced above the open top of the bottom leg cavity. The alignment guide is further adapted and configured such that, when the top leg is positioned above and axially aligned with the bottom leg, the outer peripheral portion of the top leg fits in the insertion area with a clearance, which may be a lateral clearance in all horizontal directions, and which is greater than the clearance between the inner surface of the bottom leg sidewall and the outer peripheral surface of the top leg lower end portion in the centered position. The alignment guide is further adapted and configured such that, when the outer peripheral portion of the top leg meets the insertion area, the top leg end surface is above an elevation of the open top of the bottom leg cavity. The alignment guide is further adapted and configured such that, when the top leg is suspended above the bottom leg with freedom of lateral movement, inserted into the alignment guide in a position in which the top leg lower end portion is laterally out of insertion alignment with the bottom leg cavity, and passively lowered toward the bottom module, the at least one guide member engages the outer peripheral portion of the top leg to cam the top leg towards axial alignment with the bottom leg, so that the top leg end surface is guided to within an area of the open top of the bottom leg cavity when reaching an elevation at or above that of the open top of the bottom leg cavity and held within the area of the open top of the bottom leg cavity when passively lowered for insertion therethrough. The alignment guide peripheral collar may comprises at least two members configured to be at least partially disengageable from each other to open the peripheral collar, and the method may further comprise at least partially disengaging the peripheral collar members to open the peripheral collar, and laterally removing the alignment guide from the bottom leg after the top leg is placed thereon. For example, a peripheral collar member may be articulable relative to another peripheral collar member about a joint, so as to move a portion of one of the members into and out of closure engagement with another of the members. Alternatively, one or more peripheral collar members may be fully removable from one or more other peripheral collar members to open the peripheral collar for removal from the bottom leg.

Another aspect of the present disclosure is a water management system comprising a plurality of cells and at least one tension cable extending through at least some of the cells in a series, the tension cable attaching at each end to a different wall panel and being loaded in tension to apply a compressive holding force pressing the series of cells together between the pair of wall panels. Each cell has a top flange and a base, the top flange and base having vertically aligned, like perimeters, and side openings, the side openings comprised in a peripheral cell area vertically extending from the base perimeter to the top flange perimeter. Each cell is positioned adjacent a side opening of at least one other of the cells, to permit water to flow laterally through the side opening from either of the adjacent cells to the other adjacent cell. The system further includes a plurality of wall panels collectively comprising a pair of cable attachment features for each tension cable, each tension cable attachment feature of the pair being adapted and configured for attachment of one of the tension cable ends to a different one of the wall panels. Each cell top flange defines at least a first tension cable channel extending therethrough between two spaced apart open channel ends, each of the two open channel ends being disposed at the top flange perimeter. Each cell includes a support structure extending from the top flange to the base, the support structure being surrounded by the peripheral cell area. The cells are arrayed in a manner such that the cell top flanges form a continuous top deck having a top deck perimeter, in a manner such that the cell base s form a continuous bottom deck having a bottom deck perimeter, and in a manner such that at least one first tension cable path is formed by a series of the first tension cable channels of a corresponding series of the cell top flanges. Each first tension cable path extends through the top deck and has two spaced apart open path ends disposed at the top deck perimeter. The plurality of wall panels are arranged to form a continuous wall around the top deck perimeter and the bottom deck perimeter, so that the system sidewall, the top deck, and the bottom deck cooperate to enclose a system volume that is above the bottom deck, below the top deck, and peripherally surrounded by the system sidewall. Each first tension cable path has a tension cable extending therethrough, each end of the tension cable being attached to a respective wall panel adjacent each open path end of the first tension cable path by engaging an attachment feature of a respective wall panel, the tension cable being tensioned so that the series of cell top flanges corresponding to the first tension cable path are pressed between the respective wall panels. Each cell top flange may be cast from concrete, the respective first tension cable channel comprising a conduit in the cast concrete. The conduit may be, for example, a one-inch diameter PVC pipe or sprinkler pipe. The conduit may alternatively be formed from another material, such as HDPE or another hard plastic, or a metal. A resilient spacer member may be disposed between abutting sides of each adjacent pair of cell top flanges. The resilient spacer member may have an upper flange that overlaps a top side of at least one of the adjacent pair of cell top flanges, to prevent the soft spacer member from falling through a gap between the adjacent pair of cell top flanges during construction of the system.

Another aspect of the present disclosure is a method of constructing a water management system according to the preceding aspect. The method comprises positioning the cells in a horizontal array in a manner such that a side opening of each of the cells is positioned adjacent a side opening of at least one other adjacent cell, to permit water to flow laterally through the adjacent side openings from either of the adjacent cells to the other adjacent cell, in a manner such that the cell top flanges form a continuous top deck having a top deck perimeter, in a manner such that the cell bases form a continuous bottom deck having a bottom deck perimeter. Further, the cells in the horizontal array are positioned and such that at least one first tension cable path is formed by a series of the first tension cable channels of a corresponding series of the cell top flanges, each first tension cable path extending through the top deck and having two spaced apart open path ends disposed at the top deck perimeter. The plurality of wall panels are positioned to form a continuous wall around the top deck perimeter and the bottom deck perimeter, so that the system sidewall, the top deck, and the bottom deck cooperate to enclose a system volume that is above the bottom deck, below the top deck, and peripherally surrounded by the system sidewall. A tension cable is positioned so as to extend through each first tension cable path. An attachment feature of a respective wall panel adjacent each open path end of the first tension cable path is engaged to attach a respective end of the first tension cable to the respective wall panel. Tension is imparted to the tension cable to press between the respective wall panels the series of cell top flanges corresponding to the first tension cable path.

Further features and advantages, as well as the operation, are described in detail below with reference to the accompanying drawings.

Figure 1:
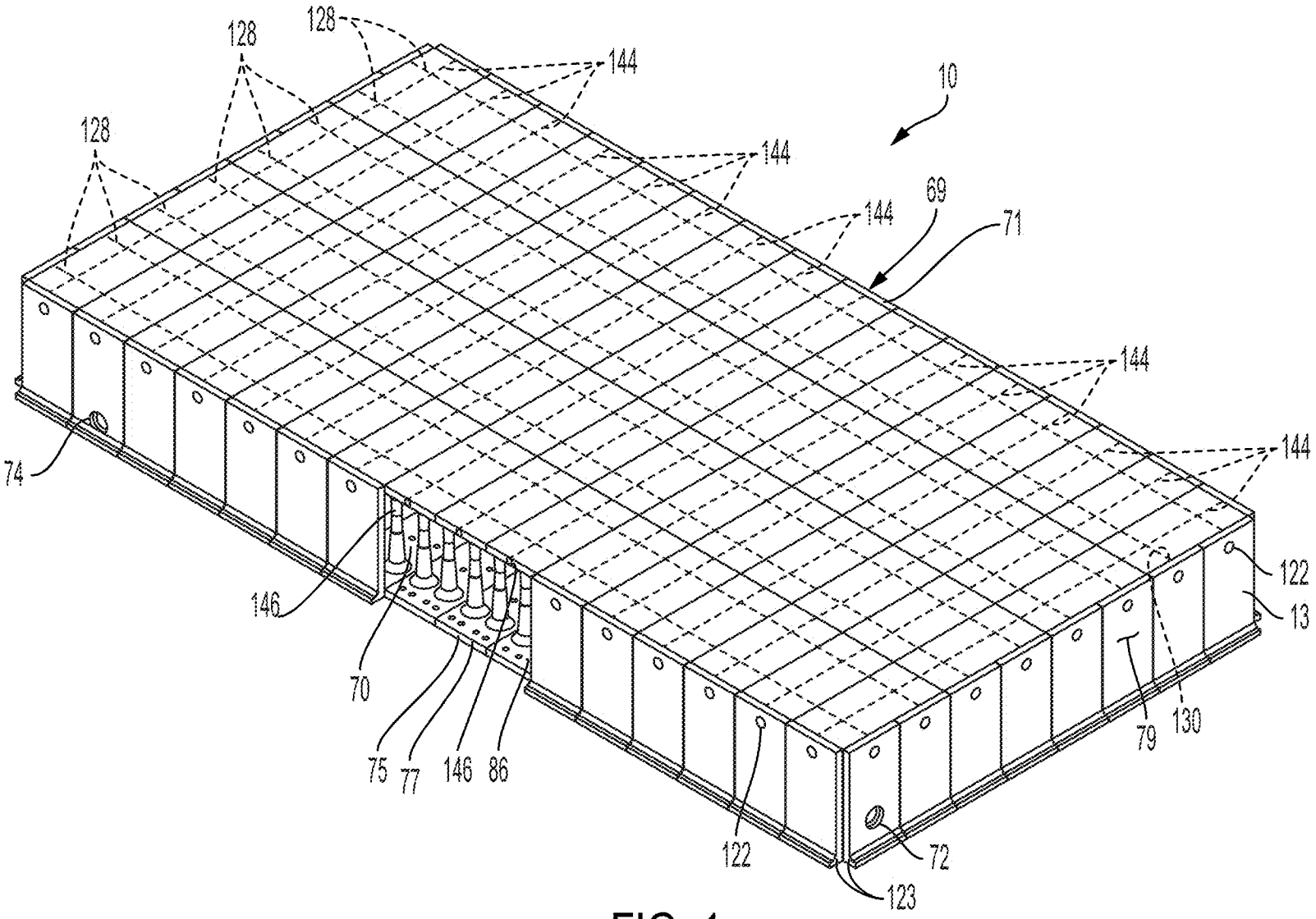
FIG. 1 is a perspective view of a water management including an array of cells.
Figure 2:
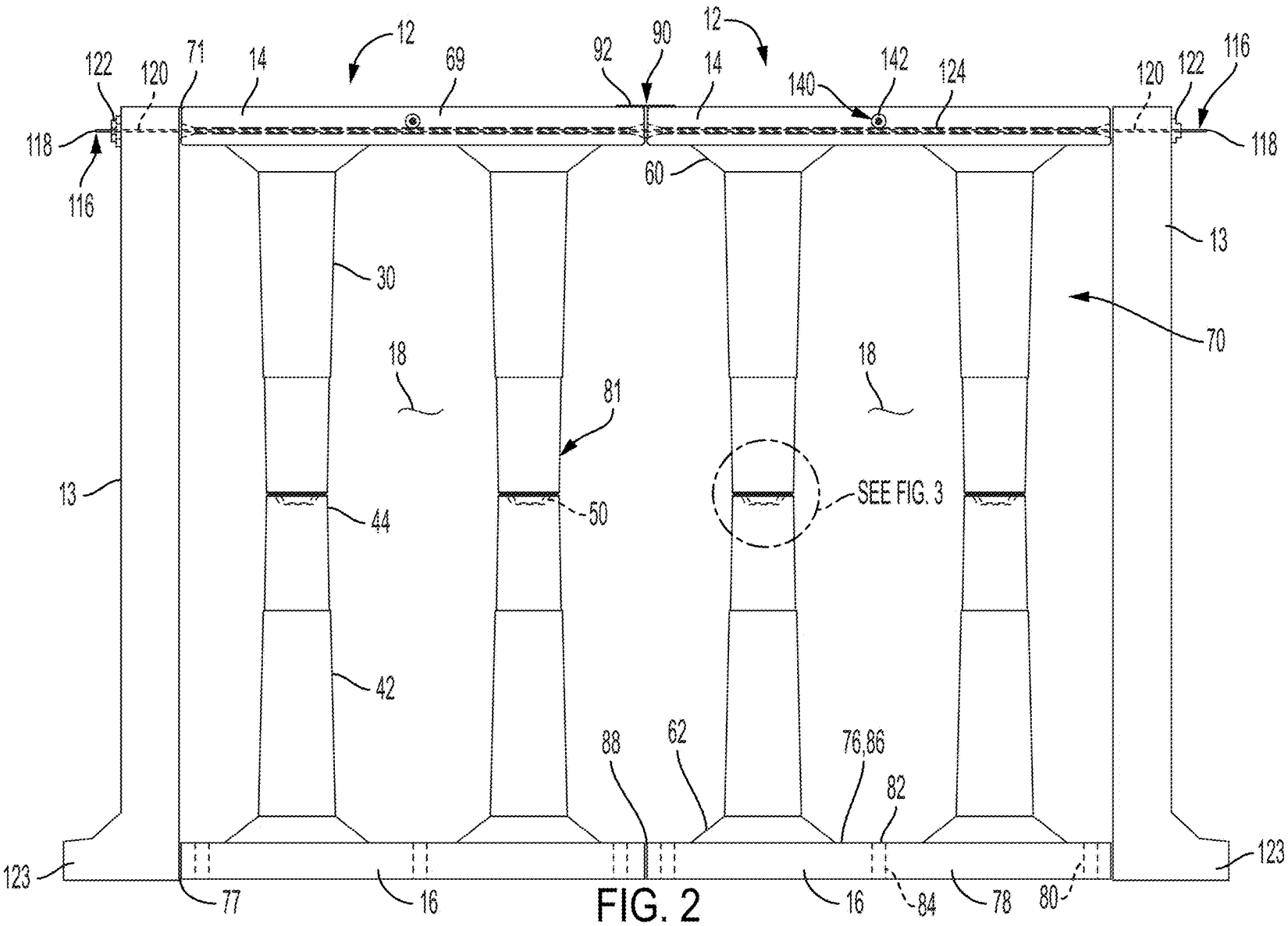
FIG. 2 is a side elevation view of a portion of a water management system as in FIG. 1 with a differently arrayed cells.

Reference numerals in the written specification and in the figures indicate corresponding items.

DETAILED DESCRIPTION

An embodiment of water management system in accordance with the present invention, which may be a storm water management system, is a water management system 10 shown in FIGS. 1-4, 5A, 5B, 6A, 6B, and 7. The water management system 10 comprises a plurality of cells 12 having a top flange 14, a bottom flange 16, and side openings 18, the side openings 18 comprised in a peripheral cell area, which in the illustrated embodiment consists of the lateral sides of a rectangular prism extending from an outer perimeter 22 of the top flange 14 to an outer perimeter 24 of the bottom flange 16. In the drawings, the peripheral cell area is not separately designated by a separate reference character, but it is a rectangular cylindrical area encompassing the union of all four side openings 18, lateral faces 25, 27, and end faces 29, 31 of top and bottom flanges 14, 16, respectively. System 10 further includes wall panels 13, which surround an array of the cells 12. In the array, each cell 12 is positioned adjacent a side opening 18 of at least one adjacent cell 12, to permit water to flow laterally through the side opening 18 from either of the adjacent cells 12 to the other adjacent cell 12. Each cell 12 includes a top module 26 and a bottom module 28.

The top module 26 comprises the top flange 14 and at least one top leg 30 integral to the top flange 14, a plan area of the top leg 30 being disposed entirely within a plan area of the top flange 14. The top leg 30 has a vertical longitudinal axis and extends perpendicularly from the top flange 14 to a top leg lower end portion 32, the top leg lower end portion 32 having an outer peripheral surface 34 and a lower end surface 36. The top leg lower end portion 32 may be, as illustrated in the drawings, a narrower projection that is axially aligned on top leg 30, having a base 41 disposed on a wider portion of the top leg 30, such as a shoulder 38 with an annular end face 40 that surrounds the base 41 of the top leg lower end portion 32, and extending longitudinally from its base 41 to its distal end, corresponding to the lower end surface 36. A height of the top leg 30, measured perpendicularly (vertically) from where it meets the top flange 14 to the base 41 of its lower end portion 32, may be several feet, such as about seven feet.

The bottom module 28 comprises the bottom flange 16 and at least one bottom leg 42 integral to the bottom flange 16, a plan area of the bottom leg 42 being disposed entirely within a plan area of the bottom flange 16. The bottom leg 42 has a vertical longitudinal axis that extends from the bottom flange 16 to a bottom leg end portion 44, the bottom leg end portion 44 having a bottom leg sidewall 46 and a recessed end surface 48 forming a bottom leg cavity 50. The bottom leg cavity 50 has a closed bottom defined by the recessed bottom leg end surface 48, a closed periphery defined by an inner surface 52 of the bottom leg sidewall 46, and an open top 54 surrounded by a rim 56 of the bottom leg sidewall 46. A height of the bottom leg 42, measured perpendicularly (vertically) from where it meets the bottom flange 16 to the rim 56 of its sidewall 46, may be several feet, such as about seven feet. At least one spacer 58 is disposed within the bottom leg cavity 50. Spacer 58 may, for example, be made of hard plastic or other material suitable for spacers or shims in heavy concrete applications.

As noted above, in the illustrated embodiment, the top leg lower end portion 32 is a downward projection from the shoulder 38 of top leg 30. Further, lower end portion 32 has a height H approximately equal to a vertical depth D of the cavity 50, the top leg shoulder 38 being wider than the cavity 50, such that the at least one spacer 58 in cavity 50 provides a vertical clearance VC between the top leg shoulder 38 and the bottom leg sidewall rim 56, while additional spacers 58 may be placed where needed to adjust for vertical construction tolerances. In another embodiment (not shown), a top leg lower end portion height H may be larger than vertical cavity depth D by a desired nominal vertical clearance between the top leg shoulder 38 and the bottom leg sidewall rim 56, and a spacer 58 may be placed in cavity 50 only when needed or desirable to adjust for vertical tolerance.

The top leg lower end portion 32 is at least partially inserted into the bottom leg cavity 50 and positioned on the at least one spacer 58, so that the at least one spacer 58 is clamped between the top leg lower end surface 36 and the bottom leg recessed end surface 48, at least a part of the outer peripheral surface 34 of the top leg lower end portion 32 being separated from the bottom leg sidewall inner surface 52 by a clearance C, which may be a lateral clearance in all horizontal directions. A flowable substance, illustrated as a grout G, in a hardened state, occupies at least a portion of the clearance C to seat the top leg lower end portion 32 within the cavity 50, grout G having a top surface exposed to an air gap within the vertical clearance VC.

One or both of the top module 26 and the bottom module 28 may be cast from concrete and may be a monolithic casting of concrete. One or both of the top module 26 and the bottom module 28 may be cast in a single casting. Each of the top leg 30 and the bottom leg 42 may be cast using a common leg base mold (not shown) terminating with a flange that bolts to a support frame, the support frame including one of two interchangeable leg end molds that create the joint detail of the respective top and bottom leg 30, 42. The top and bottom flanges 14, 16 may each be rectangular, and may, for example, be several feet wide and several feet long. The length L of each flange 14, 16 may be an integer multiple of the width W of each flange 14, 16. This facilitates the use of wall panels 13 of a single size, one wall panel 13 covering each transverse side opening 18 of the outer cells 12 of the array and multiple (two, as illustrated) wall panels 13 covering each open longitudinal side opening 18 of the outer cells 12 of the array. Top and bottom flanges 14, 16 may have, for example, a sixteen-foot by eight-foot plan area. A vertical thickness t of each deck may be several inches, such as eight inches. The top leg 30 and bottom leg 42 may each be round (as may be top leg lower end portion 32 and bottom leg cavity 50) and include a respective round capital 60, 62 where each meets the respective flange 14, 16, each leg and each capital having a frustoconical lateral surface.

In the illustrated embodiment, the bottom leg sidewall rim 56 comprises an upwardly facing flat surface of the bottom leg sidewall 46 that defines an opening 64 coinciding with the open top 54 of the bottom leg cavity. The grout G has a flat surface that is flush with the flat surface of the bottom leg sidewall rim 56. Being exposed to an air gap within vertical clearance VC, the flat surface of grout G does not abut any part of the top leg 30.

In the illustrated embodiment, it is contemplated that the vertical clearance VC is not large enough to permit insertion of grout injection means (not shown) such as a tube or nozzle between top leg 30 and bottom leg 42, to fill cavity 50 with a grout G. Accordingly, a channel 66 formed in the top leg shoulder 38, the channel 66 extending inwardly from an outer side 68 of the shoulder 38 toward the base 41 of the top leg lower end portion 32, the channel 66 being operative to accommodate flow of grout G in a flowable state (in which grout G has a sufficiently fluid consistency to passively form a generally flat, horizontal top surface after settling in the cavity 50) from the outer side 68 of the shoulder 38 to the cavity 50 when the top leg lower end portion 32 is positioned on the at least one spacer 58 disposed within the cavity 50, grout G in its hardened state being formed by curing within the cavity 50 after being introduced therein in its flowable state. Thus the bottom leg 42 and the top leg 30 combine to form a support column 81 configured to transmit a load from the top flange 14 to the bottom flange 16.

Cells 12 are arrayed such that cell top flanges 14 combine to form a continuous top deck 69 having a top deck perimeter 71, and such that cell bottom flanges 16 combine to form a continuous bottom deck 75 having a bottom deck perimeter 77. The wall panels 13 are arranged to form a continuous system sidewall 79 around and the top deck perimeter 71 and the bottom deck perimeter 77, so that the system sidewall 79, the top deck 69, and the bottom deck 75 cooperate to enclose a system volume 70 that is above the bottom deck 75, below the top deck 69, and peripherally surrounded by the system sidewall 79.

System 10 is configured to be constructed and deployed below ground, embedded in soil, and has an internal volume 70 and one or more features to permit water to enter its internal volume 70 in response to an external influx of water resulting in saturation of the surrounding soil, as well as to permit the water to drain more gradually therefrom. This allows system 10 to act as a passive water management buffer for the surrounding environment. Accordingly, at least one one-way inlet 72 and at least one one-way outlet 74 may be comprised in one or more of wall panels 13. In addition, each bottom flange 14 comprises a top surface 76, a bottom surface 78, and a fluid channel 80 extending from an opening 82 in the top surface 76 to an opening 84 in the bottom surface 78, the bottom flange top surface 76 forming part of a bottom interior surface 86 of system 10. Thus, water may seep into internal volume 70 through one-way inlet 72 when the lateral exterior becomes saturated, may rise into internal volume 70 through fluid channels 80 when the underlying exterior becomes saturated, thereby relieving the surrounding environment of excess water above saturation levels, and may begin to gradually drain out of internal volume 70 through one-way outlet 74 and fluid channels 80 once the water pressures at the external sides/ends thereof drop sufficiently to allow a net outflow from internal volume 70.

According to a method of constructing system 10, cell bottom modules 28 are first positioned in an array so that the plan areas of bottom flanges 16 are in tessellated alignment. The rectangular shape of the plan areas of bottom flanges 16 permit allows for a tessellated array of regular shapes. Other suitable cell shapes that may form tessellated arrays include isosceles or equilateral triangles and regular hexagons. Resilient spacers 88 of a common thickness, such as ½ inch, may be disposed between abutting sides of each adjacent pair of bottom flanges 16, to inhibit wear resulting from bottom flanges 16 rubbing together. At least one spacer 58 is disposed on each bottom leg recessed end surface 48 entirely below the open top 54 of the cavity 50. A cell top module 26 is placed on each cell bottom module 28 in the array, after the spacer 58 is placed in its bottom leg cavity 50, by inserting each top leg lower end portion 32 into the respective bottom leg cavity 50. The horizontal positions of top leg lower end portions 32 are adjusted within the bottom leg cavities 50 so that the plan areas of top flanges 14 are in tessellated alignment. each of cells 12 being positioned adjacent a side opening 18 of at least one other of cells 12. Resilient spacers 90, which may be provided in variable thicknesses ranging from smaller than that of resilient spacers 88 to larger than that of resilient spacers 88, such as ¼ inch, ½ inch and ¾ inch, to adjust for construction tolerances as needed, are positioned between abutting sides of each adjacent pair of top flanges 14. Resilient spacers 90 may include an upper flange 92 that overlaps a top side of at least one of the adjacent pair of cell top flanges 14, to prevent the resilient spacer 90 from falling through a gap between the adjacent pair of cell top flanges 14 before alignment of cell top flanges 14 is completed. When each top leg lower end portion 32 is so inserted into and horizontally positioned within the respective bottom leg cavity 50, such that the at least one spacer 58 is disposed between the top leg lower end surface 36 and the bottom leg recessed end surface 48, a balance of each cavity 50 is at least partially filled with a flowable substance, such as grout G. Preferably, grout G is filled to a level no higher than the open top 54 of the cavity 50, and more preferably to a level approximately aligned with the open top 54 of the cavity 50, as illustrated in the drawings. Grout G is caused to harden, such as by leaving grout G in the cavity 50 for a hardening time, to seat the inserted and horizontally positioned top leg lower end portion 32 in the cavity 50.

The method may further includes, before positioning a cell top module 26 on each cell bottom module 28, mounting an alignment guide 94 on the bottom leg 42. The alignment guide 94 comprises a peripheral collar 96, the peripheral collar extending around and engaging an outer peripheral surface 98 of the bottom leg 42, to support the alignment guide 94 when mounted on the bottom leg 42. At least one guide member, illustrated in the drawings as a plurality of elongate prongs 100, is operatively connected to peripheral collar 96 so as to taper upwardly and outwardly from the peripheral collar 96. As illustrated in the drawings, elongate prongs 100 are spaced apart about a perimeter of the peripheral collar 96 by small enough distances to restrict the top leg 30 to an area surrounded by the elongate prongs 100 once the top leg 30 is partially inserted into the area surrounded by the elongate prongs 100. Upper ends 102 of elongate prongs 100 collectively comprise an upper end of the guide member, defining an insertion area 104 generally surrounded by upper ends 102, the insertion area 104 configured for insertion of the shoulder 38 of the top leg 30 downwardly therethrough. The alignment guide 94 is adapted and configured such that, when the alignment guide 94 is mounted on the bottom leg 42, the insertion area 104 is spaced above the open top 54 of the bottom leg cavity.

The alignment guide 94 is further adapted and configured such that, when the top leg 30 is positioned above and axially aligned with the bottom leg 42, the shoulder 38 of the top leg 30 fits in the insertion area 104 with a shoulder clearance SC, which may be a lateral clearance in all horizontal directions, and which is greater than the clearance C between the inner surface 52 of the bottom leg sidewall 46 and the outer peripheral surface 34 of the top leg lower end portion 32 in the centered position. The alignment guide 94 is further adapted and configured such that, when the shoulder 38 of the top leg 30 meets the insertion area 104, the top leg lower end surface 36 is above an elevation of the open top 54 of the bottom leg cavity 50.

The alignment guide 94 is further adapted and configured such that, when the top leg 30 is suspended above the bottom leg 42 with freedom of lateral movement, inserted into the alignment guide 94 in a position in which the top leg lower end portion 32 is laterally out of insertion alignment with the bottom leg cavity 50, and passively lowered toward the bottom leg 42, at least one of the elongate prongs 100 engages the shoulder 38 of the top leg 30 to cam the top leg 30 towards axial alignment with the bottom leg 42. The top leg end surface 36 is thus guided to within an area of the open top 54 of the bottom leg cavity 50 when reaching an elevation at or above that of the open top 54 of the bottom leg cavity 50, and held within the area of the open top 54 of the bottom leg cavity 50 when further passively lowered, for insertion therethrough. The alignment guide peripheral collar 96 may comprise at least two members 106, 108 configured to be at least partially disengageable from each other to open the peripheral collar 96, and the method may further comprise at least partially disengaging the peripheral collar members 106, 108 to open the peripheral collar 96, and laterally removing the alignment guide 94 from the bottom leg 42 after the top leg 30 is placed thereon. For example, peripheral collar member 106 may be articulable relative to peripheral collar member 108 about a hinge 110, so as to move respective distal ends 112, 114 of peripheral collar members 106, 108 into and out of closure engagement with each other. Alternatively, though not shown, one or more peripheral collar members may be fully removable from one or more other peripheral collar members to open a peripheral collar for removal of the peripheral collar from bottom leg 42 after top leg 30 is in place. When top and bottom flanges 14, 16 include a plurality of respective top and bottom legs 30, 42, as in the illustrated embodiment, it is beneficial to mount an alignment guide 94 on at least two of bottom legs 42, such that, when shoulders 38 of the respective top legs 30 are inserted into the respective alignment guide insertion area 104, the two alignment guides 94 cooperate to retrain top module 26 from rotating out of alignment with bottom module 28 as it is passively lowered thereon.

Turning to another aspect of the present disclosure, a water management system may employ a tension cabling system that provides holding forces tending to resist separation of tightly arrayed (e.g., tessellated) cells thereof in the event of seismic activity. Thus, system 10 includes tension cables 116, each tension cable 116 extending through an aligned series of the cells 12 along the first horizontal direction, the tension cable 116 attaching at each of its ends 118 to a different wall panel 13 and being loaded in tension to apply a compressive holding force pressing the series of cells 12 together between the pair of wall panels 13 along the first horizontal direction.

Wall panels 13 collectively comprise a pair of cable attachment features 120 for each tension cable 116, each tension cable attachment feature 120 of the pair being adapted and configured for attachment of one of the tension cable ends 118 to a different one of the wall panels 13. In the illustrated embodiment, tension cable attachment feature 120 comprises a through hole extending through a thickness of the wall panel 13 from an inner side to an outer side of the wall panel 13. The through hole is sized and shaped to permit a tension cable locking nut assembly 122 that retains a respective end 118 of tension cable 116 to be braced against the outer side of wall panel 13 adjacent the through hole. Additionally, wall panels 13 include a bottom flange 123 to assist with flotation of the structure in saturated soils.

Each top flange 14 defines at least one first tension cable channel 124 extending therethrough between two spaced apart open channel ends 126 in a first horizontal direction, each of the two open channel ends 126 being disposed at the top flange perimeter 22. Cells 12 are arrayed in a manner such that first tension cable paths 128 are formed by a series of the first tension cable channels 124 of corresponding series of the cell top flanges 14. Each first tension cable path 128 extends through the top deck 69 and has two spaced apart open path ends 130 disposed at the top deck perimeter 71. Each first tension cable path 128 has a tension cable 116 extending therethrough, each end 118 of the tension cable 116 being attached to a respective wall panel 13 adjacent each open path end 130 of the first tension cable path 128 by engaging an attachment feature 120 of a respective wall panel 13, the tension cable 116 being tensioned so that the series of cell top flanges 14 corresponding to the first tension cable path 128 are pressed between the respective wall panels 13. Each cell top flange 14 may be cast from concrete, the respective first tension cable channel 124 comprising a conduit 132 in the cast concrete. The conduit 132 may be, for example, a 1-inch diameter PVC pipe or sprinkler pipe, to fit ½-inch diameter tension cables 116. The conduit 132 may alternatively be formed from another material, such as HDPE or another hard plastic, or a metal.

A portion of one of resilient spacer members 90 is disposed in a respective first tension cable path 128 that extends through each pair of aligned open channel ends 126 of respective first tension cable channels 124 of an adjacent pair of cell top flanges 14 aligned along the first tension cable path 128. Accordingly, each resilient spacer member 90 has a hole 134 through which the respective tension cable 116 extends. For example, the opening 134 may be pre-formed in the resilient spacer member 90, or at least part of the portion of the spacer member 90 that is disposed in the first tension cable path 128 may be pre-perforated or otherwise frangible, to permit the tension cable 116 to break through the frangible portion to form the opening 134 as the tension cable 116 is pushed through the tension cable path 128 during construction of the system 10.

Each first tension cable channel 124 comprises a central portion 136 of uniform cross section and two flared end portions 138, each flared end portion 138 having a cross section that widens from an end of the central portion 136 to a respective one of the two open channel ends 126 of the first tension cable channel 124. Flared end portions 138 provide for a greater range of relative translation of adjacent top flanges 14 in the vertical plane of their abutting sides, for example, in the event of an earthquake, before the respective tension cable 116 becomes pressed between displaced opposite edges of the corresponding adjacent open channel ends 126, potentially resulting in damage to the tension cable 116, the pair of top flanges 14, or both.

Each top flange 14 preferably has at least one first tension cable path 128 extending through a respective first tension cable channel 124 thereof, so as to be held together with neighboring top flanges 14 by the holding force in the first horizontal direction produced by at least one of tension cables 116. In the illustrated embodiment, two first tension cables 116 extend through each top flange 14 in the first horizontal direction, the respective first tension cable channels 124 extending through and being spaced apart along the long side of top flange 14.

Each cell top flange 14 further defines at least a second tension cable channel 140 extending therethrough in a second horizontal direction intersecting the first horizontal direction. Each second tension cable channel 140 has two spaced apart open channel ends 142, each of the two open channel ends 142 being disposed at the top flange perimeter 22. Similarly to first tension cable channel 124, second tension cable channel 140 has a central portion 141 of uniform cross section and flared ends 143 extending from the central portion 141 to respective open channel ends 142. The cells 12 are arrayed such that tension cable paths 144 are formed by series of the second tension cable channels 140 of corresponding series of the cell top flanges 14, each second tension cable path 144 extending through the top deck 69 and having two spaced apart open path ends 146 disposed at the top deck perimeter 71. Each second tension cable path 144 has a tension cable 116 extending therethrough, each end of the tension cable 116 being attached to a respective wall panel 13 adjacent each open path end 146 of the second tension cable path 144 by engaging an attachment feature 120 of a respective wall panel, the tension cable 116 being tensioned so that the series of cell top flanges 14 corresponding to the second tension cable path 144 are pressed between the respective wall panels 13 along the second horizontal direction.

The first tension cable channels 124 and the second tension cable channel 140 of each top flange 14 may be straight, horizontal channels of like diameter, which are vertically offset from each other by a distance larger than their diameter, to avoid intersecting each other, as shown in the drawings. In an alternative embodiment, each of the first tension cable channels of a cell top flange may intersect the second tension cable channel at a respective junction (not shown). The tension cables 116 and/or the junction may be sized, adapted, and configured so that a tension cable 116 already extending through the junction along one of the channels does not undesirably interfere with passing a tension cable 116 through the junction along the other channel.

Preferably, and in the illustrated embodiment, the second direction is perpendicular to the first horizontal direction, so that the respective tension cables 116 are likewise perpendicularly oriented, so as to efficiently produce holding forces that combine to resist separation of top flanges 14 in any horizontal direction, while neither the tension cables 116 oriented in the first horizontal direction nor the tension cables 116 oriented in the second horizontal direction produce forces that interfere with the lines of action of the tension cables 116 aligned in the other direction. As with the first tension cable paths 128, each second tension cable path 144 has portions of resilient spacers 90 extending thereacross at the union of each adjacent pair of second cable channels 140, each resilient spacer having a hole 134 through which a corresponding tension cable 116 extends.

Figure 3:
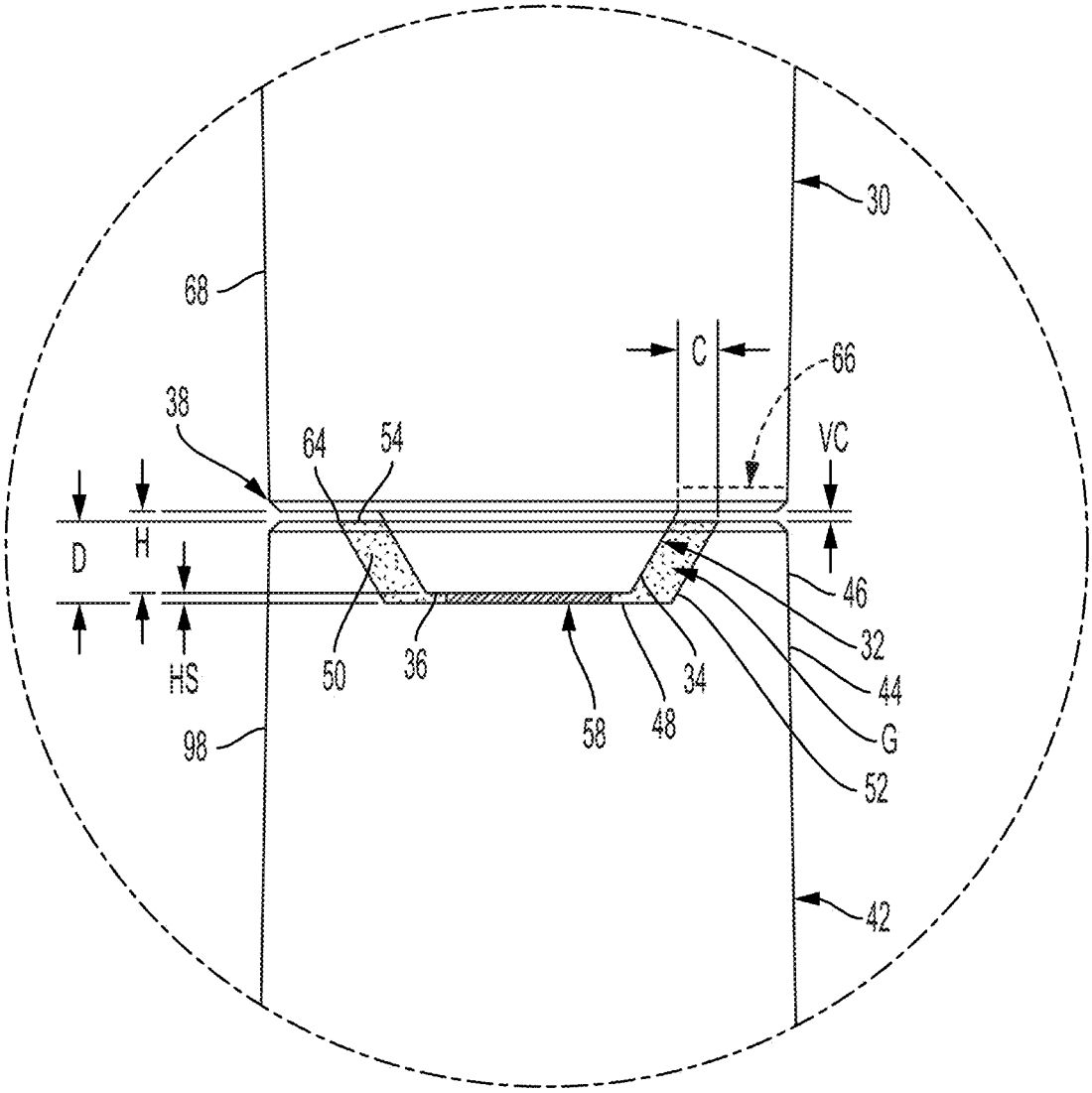
FIG. 3 is an enlarged truncated side elevation view of a leg joint of the water management system of FIG. 1.
Figure 4:
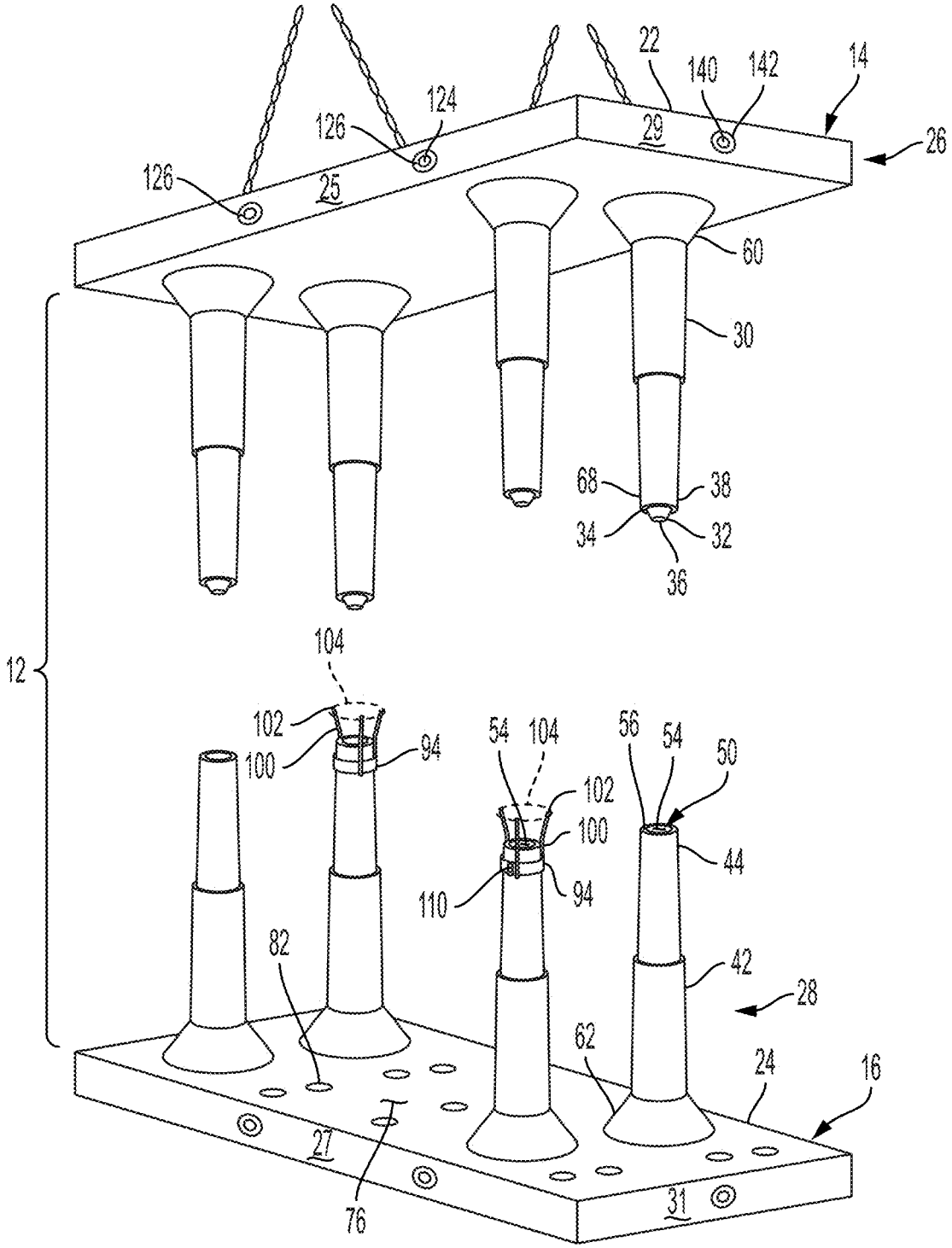
FIG. 4 is a perspective illustration of the assembly of a cell of a water management system of FIG. 1.
Figure 5A:
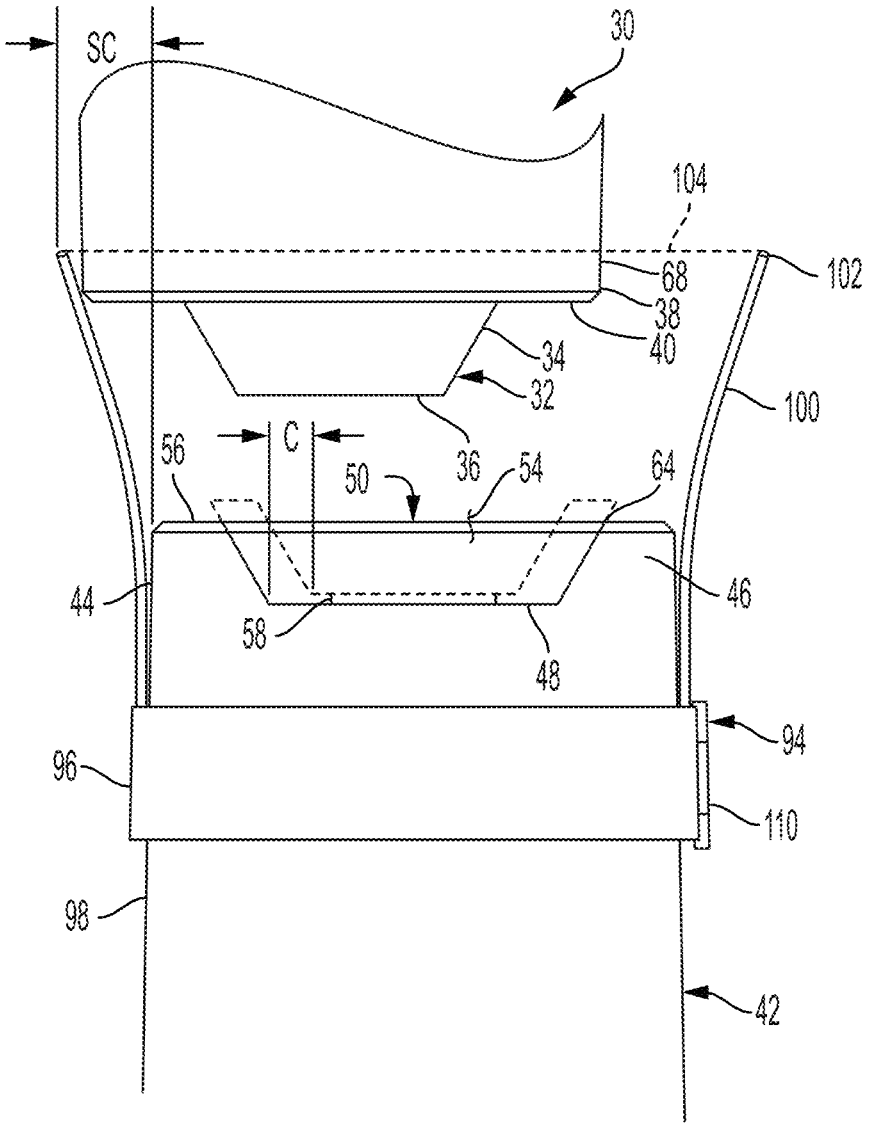
FIG. 5A is an enlarged truncated side elevation illustration of the assembly of a leg joint of a water management system of FIG. 1.
Figure 5B:
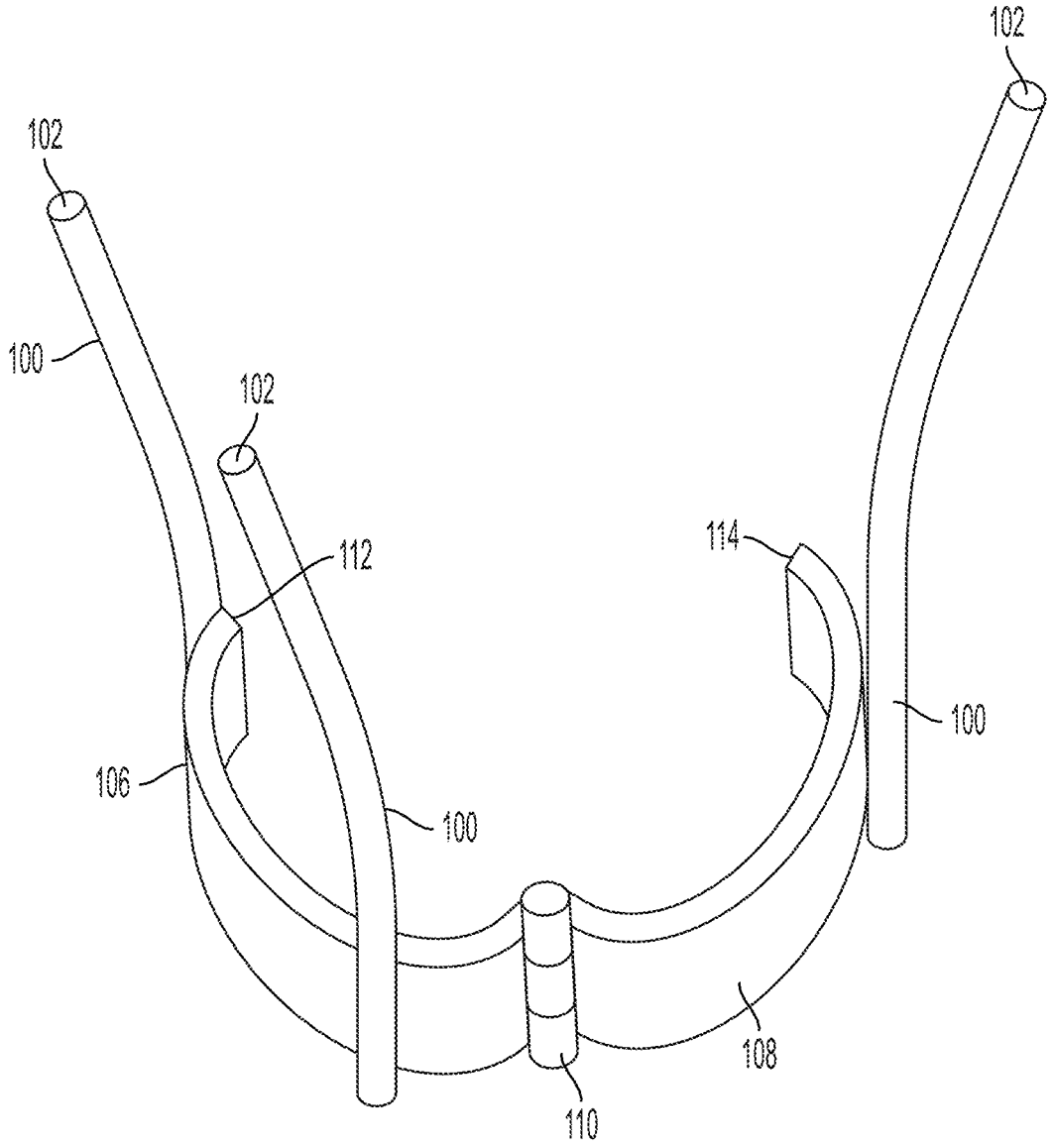
FIG. 5B is a perspective view of an alignment guide used in the assembly of a leg joint illustrated in FIG. 5A.
Figure 6A:
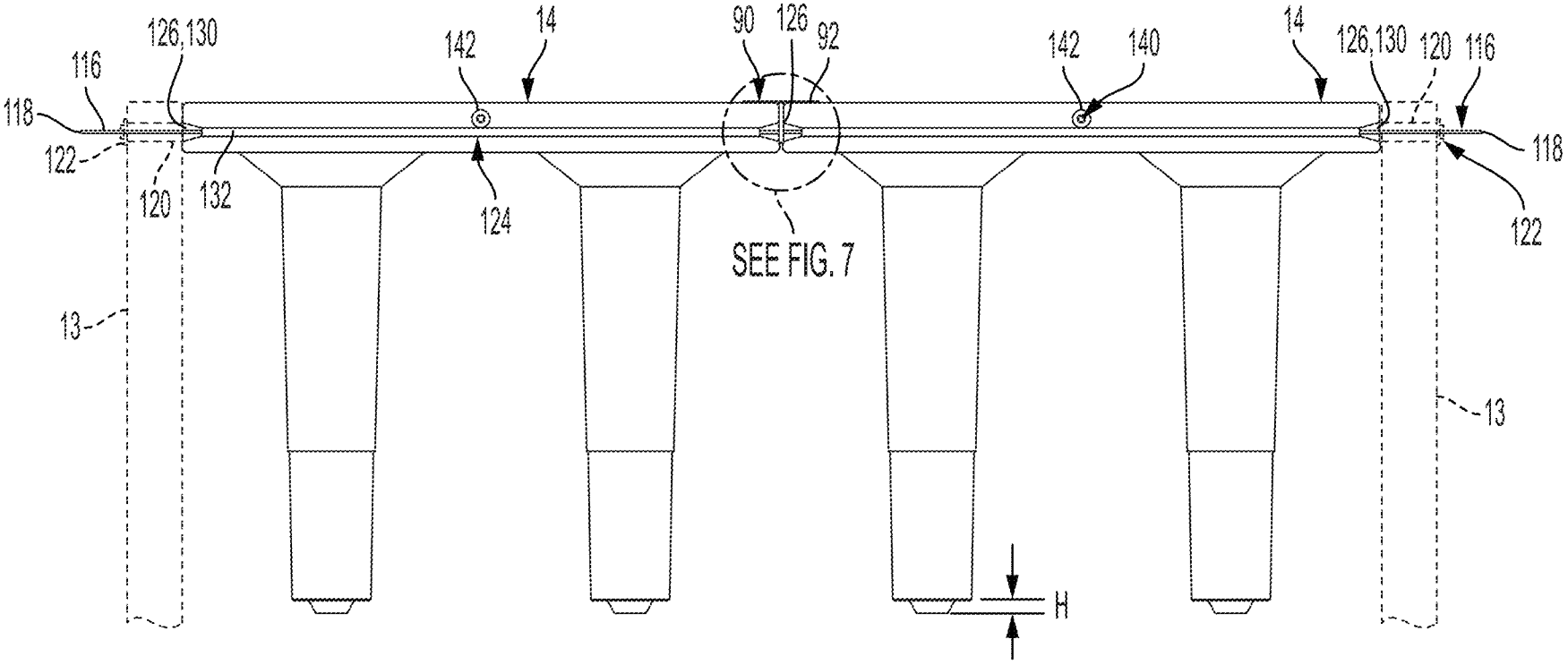
FIG. 6A is a side elevation view of cell top modules of the water management system as in FIG. 2.
Figure 6B:
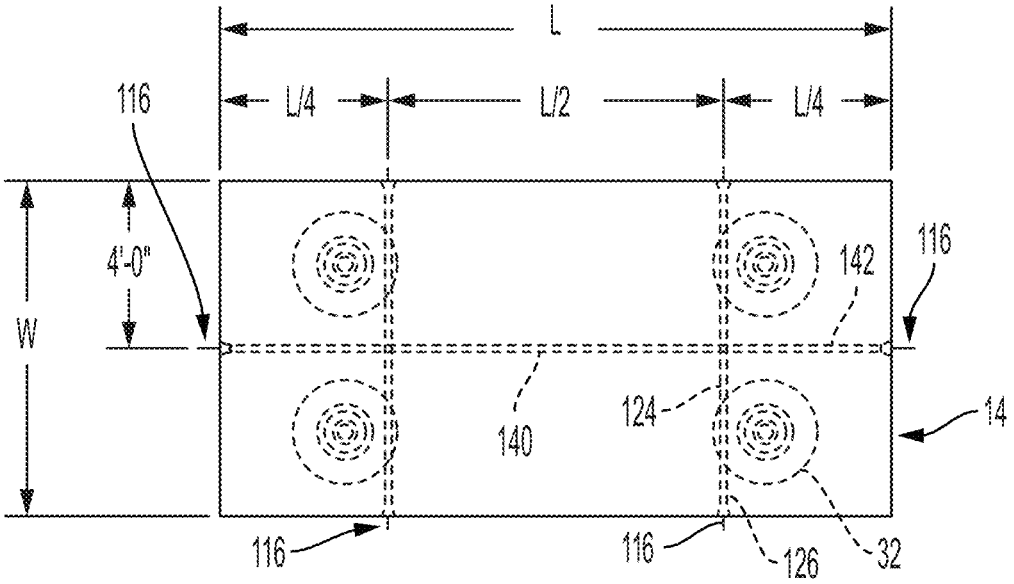
FIG. 6B is a top plan view of a cell top module of the water management system of FIG. 1.
Figure 7:
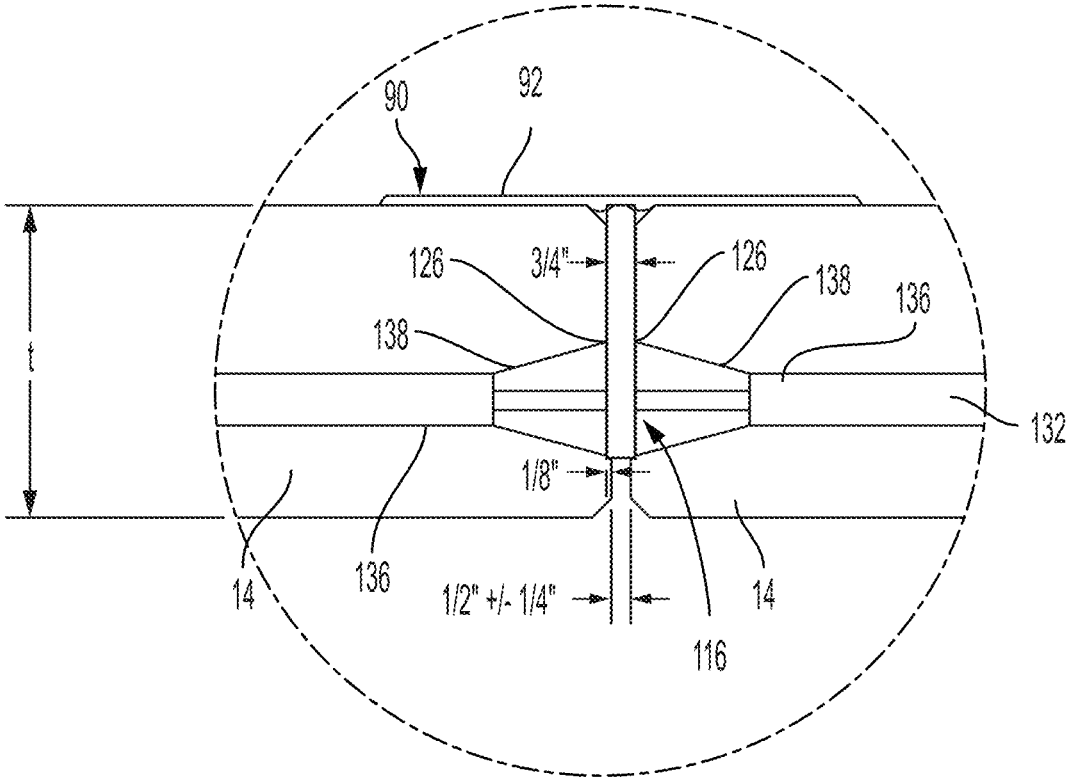
FIG. 7 is an enlarged cross section of a cell top flange joint of the water management system of FIG. 1.
Figure 8:
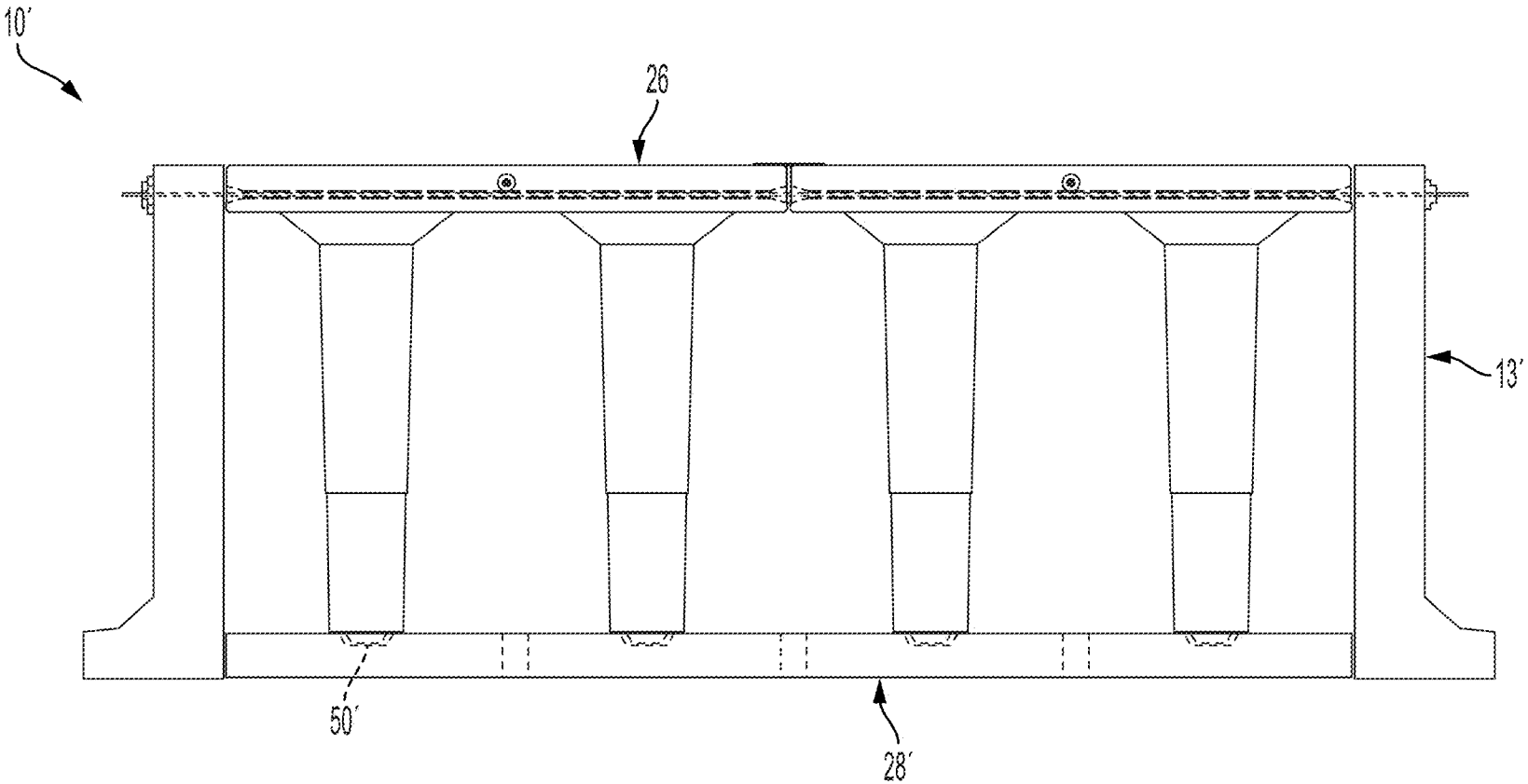
FIG. 8 is an elevation view of part of an alternative water management system.

In water management systems of the present disclosure, a greater system height has the advantage of providing greater internal water holding volume for a given construction cost. On the other hand, the environment of a particular water management project may impose a maximum constraint on the height of a system that can be accommodated. Thus, turning to an alternative embodiment, a water management system 10', having a lower vertical profile than system 10, is shown in FIG. 8. System 10' includes the same top modules 26 as in system 10 and wall panels 13' that are similarly configured to wall panels 13 of system 10 but shorter, but differs from system 10 in its alternative bottom modules 28'. The bottom module 28' may be, for example, a flat, rectangular concrete pad matching the plan dimensions of top flange 14, including cavities 50' in its top surface for receiving top leg lower end portions 32. For environments in which the vertical space available is on the order of the height of a cell module leg that can be cast in a single casting, the configuration of system 10' is believed to have certain advantages over a system in which the top and bottom modules each include shorter legs. For example, a lower module 28 that is out of level alignment at a given tilt angle may result in a significant horizontal offset of cavities 50 from their level positions by legs 42 shifting out of plumb alignment. In contrast, cavities 50', being closer to the bottom of the module and thus to its tilting axis, have their lateral positions less affected by any tilting of bottom module 28'. This reduces the likelihood of an upper module, which may, for example, be suspended from a chain during placement as shown in FIG. 3, impinging on a neighboring module as lower leg end portions 32 are lowered into place in cavities 50'.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A water management system adapted to be deployed below ground, comprising:

a plurality of cells having a top flange, a bottom flange, and side openings, the side openings comprised in a peripheral cell area extending from an outer perimeter of the top flange to an outer perimeter of the bottom flange, each cell being adapted and configured to be positioned adjacent a side opening of at least one adjacent cell in a manner to permit water to flow laterally through the side opening from either of the adjacent cells to the other adjacent cell;

at least one inlet to permit water to flow into the water management system;

each cell including a top module and a bottom module;

the top module comprising the top flange and at least one top leg integral to the top flange, a plan area of the top leg being disposed entirely within a plan area of the top flange, the top leg having a longitudinal axis and extending perpendicularly from the top flange to a top leg lower end portion, the top leg lower end portion having an outer peripheral surface and an end surface;

the bottom module comprising the bottom flange and at least one bottom leg integral to the bottom flange, a plan area of the bottom leg being disposed entirely within a plan area of the bottom flange, the bottom leg having a longitudinal axis and extending perpendicularly from the bottom flange to a bottom leg end portion, the bottom leg end portion having a bottom leg sidewall and a recessed end surface forming a bottom leg cavity, the bottom leg cavity having a closed bottom defined by the recessed bottom leg end surface, a closed periphery defined by an inner surface of the bottom leg sidewall, and an open top surrounded by a rim of the bottom leg sidewall, the bottom leg cavity being operative to fit the top leg lower end portion inserted in a centered position therein with a clearance between the inner surface of the bottom leg sidewall and the outer peripheral surface of the top leg lower end portion;

at least one spacer being disposed within the bottom leg cavity, and the top leg lower end portion being at least partially inserted into the bottom leg cavity and positioned on the at least one spacer so that the at least one spacer is clamped between the top leg lower end surface and the bottom leg recessed end surface, at least a part of the outer peripheral surface of the top leg lower end portion being separated from the inner surface of the bottom leg sidewall by the clearance; and a flowable substance in a hardened state occupying at least a portion of the clearance to seat the top leg lower end portion within the clearance.

2. The water management system according to claim 1, wherein at least one of the top module and the bottom module is cast from concrete.

3. The water management system according to claim 2, wherein the at least one of the top module and the bottom module is a monolithic casting of concrete.

4. The water management system according to claim 1, wherein the bottom leg sidewall rim comprises an upwardly facing flat surface of the bottom leg sidewall that defines an opening coinciding with the open top of the bottom leg cavity.

5. The water management system according to claim 4, wherein the hardened flowable substance has a flat surface that is flush with the flat surface of the bottom leg sidewall rim.

6. The water management system according to claim 1, wherein the top leg further comprises an axially aligned terminal downward projection having a base and a distal end, the terminal downward projection extending downwardly along the longitudinal axis from the base to the distal end; and a shoulder surrounding the base of the terminal downward projection; wherein the terminal downward projection comprises the top leg lower end portion, and the distal end of the terminal downward projection comprises the end surface of the top leg lower end portion; and the top leg shoulder is spaced above the bottom leg sidewall rim and spaced above the exposed top surface of the hardened flowable substance.

7. The water management system according to claim 6, further comprising a channel formed in the top leg shoulder, the channel extending inwardly from an outer side of the shoulder toward the base of the terminal downward projection, the channel being operative to accommodate flow of the flowable substance in a flowable state from the outer side of the shoulder to the cavity when the top leg lower end portion is positioned on the at least one spacer disposed within the cavity, the flowable substance in the hardened state being formed by the flowable substance in the flowable state curing within the cavity to the hardened state.

8. The water management system according to claim 1, wherein the cell bottom flange comprises a top surface, a bottom surface, and a fluid channel extending from an opening in the top surface to an opening in the bottom surface, the bottom flange top surface forming part of a bottom interior surface of the water management system, such that water is permitted to drain out of the water management system by passing through the top surface opening to the bottom surface opening.

9. The water management system according to claim 1, wherein the cell top flanges are arrayed to form a continuous top deck having a top deck perimeter, the cell bottom flanges are arrayed to form a continuous bottom deck having a bottom deck perimeter, the water management system further comprising a plurality of wall panels arranged to form a continuous system sidewall around the top deck perimeter and the bottom deck perimeter, so that the system sidewall, the top deck, and the bottom deck cooperate to enclose a system volume that is above the bottom deck, below the top deck, and peripherally surrounded by the system sidewall.

10. The water management system according to claim 1, wherein the bottom leg and the top leg combine to form a support column configured to transmit a load from the top flange to the bottom flange.

11. A water management system adapted to be deployed below ground, comprising:

a plurality of cells, each cell having a top flange and a base, the top flange and base having vertically aligned, like perimeters, and side openings, the side openings comprised in a peripheral cell area vertically extending from the base perimeter to the top flange perimeter, each of the cells being positioned adjacent a side opening of at least one other of the cells, to permit water to flow laterally through the side opening from either of the adjacent cells to the other adjacent cell;

at least one inlet to permit water to flow into the water management system;

a plurality of wall panels; and at least one tension cable having two ends, the plurality of wall panels collectively comprising a pair of cable attachment features for each tension cable, each tension cable attachment feature of the pair being adapted and configured for attachment of one of the tension cable ends to a different one of the wall panels;

the top flange of each cell defining at least a first tension cable channel extending therethrough between two spaced apart open channel ends, each of the two open channel ends being disposed at the top flange perimeter, and each cell including a support structure extending from the top flange to the base, the support structure being surrounded by the peripheral cell area;

the cells being arrayed such that the cell top flanges form a continuous top deck having a top deck perimeter, such that the cell bases form a continuous bottom deck having a bottom deck perimeter, and such that at least one first tension cable path is formed by a series of the first tension cable channels of a corresponding series of the cell top flanges, each first tension cable path extending through the top deck and having two spaced apart open path ends disposed at the top deck perimeter;

the plurality of wall panels being arranged to form a continuous wall around the top deck perimeter and the bottom deck perimeter, so that the system sidewall, the top deck, and the bottom deck cooperate to enclose a system volume that is above the bottom deck, below the top deck, and peripherally surrounded by the system sidewall;

each first tension cable path having a tension cable extending therethrough, each end of the tension cable being attached to a respective wall panel adjacent each open path end of the first tension cable path by engaging an attachment feature of a respective wall panel, the tension cable being tensioned so that the series of cell top flanges corresponding to the first tension cable path are pressed between the respective wall panels.

12. The water management system according to claim 11, each cell top flange being cast from concrete, the respective first tension cable channel comprising a conduit in the cast concrete.

13. The water management system according to claim 11, further comprising a resilient spacer member disposed between respective abutting sides of each adjacent pair of cell top flanges.

14. The water management system according to claim 13, a portion of the spacer member being disposed in a first tension cable path between aligned open channel ends of respective first tension cable channels of an adjacent pair of cell top flanges, the spacer member having an opening therein, through which the respective tension cable extends.

15. The water management system according to claim 11, each first tension cable channel comprising a central portion of uniform cross section and a flared end portion, the flared end portion having a cross section that widens from an end of the central portion to at least one of the two spaced apart open channel ends of the first tension cable channel.

16. The water management system according to claim 11, wherein each first tension cable channel extends in a first horizontal direction, each cell top flange defines at least a second tension cable channel extending therethrough in a second horizontal direction intersecting the first horizontal direction, the second tension cable channel having two spaced apart open channel ends, each of the two open channel ends being disposed at the top flange perimeter, the cells being arrayed such that at least one second tension cable path is formed by a series of the second tension cable channels of a corresponding series of the cell top flanges, each second tension cable path extending through the top deck and having two spaced apart open path ends disposed at the top deck perimeter; and each second tension cable path has a tension cable extending therethrough, each end of the tension cable being attached to a respective wall panel adjacent each open path end of the second tension cable path by engaging an attachment feature of a respective wall panel, the tension cable being tensioned so that the series of cell top flanges corresponding to the second tension cable path are pressed between the respective wall panels.

17. A method of constructing a water management system adapted to be deployed below ground, comprising a horizontal array of cells, each of the cells comprising a cell bottom module and a cell top module; each cell bottom module having a bottom flange and at least one bottom leg integral to the bottom flange, a plan area of the bottom leg being disposed entirely within a plan area of the bottom flange, the bottom leg having a longitudinal axis that extends perpendicularly from the bottom flange to a bottom leg end portion, the bottom leg end portion having a bottom leg sidewall defining a bottom leg cavity, the bottom leg cavity having a closed bottom defined by a recessed end surface of the bottom leg, closed sides defined by an inner surface of the bottom leg sidewall, and an open top surrounded by a rim of the bottom leg sidewall; each cell top module having a top flange and at least one top leg integral to the top flange, a plan area of the top leg being disposed entirely within a plan area of the top flange, the top leg having a longitudinal axis that extends perpendicularly from the top flange to a top leg lower end portion, the top leg lower end portion having an outer peripheral surface and an end surface disposed over the recessed end surface of the bottom leg of the bottom module, the method comprising:

positioning the cell bottom modules in an array so that the bottom flange plan areas are in tessellated alignment in a manner such that the cells comprise side openings, wherein the side openings are comprised in a peripheral cell area extending vertically from the bottom flange perimeter to the top flange perimeter, and in a manner such that each of the cells is positioned adjacent a side opening of at least one other of cells, to permit water to flow laterally through the side opening from either of the adjacent cells to the other adjacent cell;

positioning at least one spacer on the bottom leg recessed end surface so that the at least one spacer is disposed entirely below the open top of the cavity;

positioning a cell top module on each cell bottom module in the cell bottom module array by inserting each top leg lower end portion into the respective bottom leg cavity;

horizontally adjusting the top leg lower end portions within the bottom leg cavities relative to a centered position of the top leg lower end portion that provides a clearance between the inner surface of the bottom leg sidewall and the outer peripheral surface of the top leg lower end portion, so that the top flange plan areas are in tessellated alignment in a manner such that the cells comprise side openings, wherein the side openings are comprised in an area defined by projecting a perimeter of the bottom flange vertically to meet a like perimeter of the top flange disposed in vertical alignment with the bottom flange perimeter, and in a manner such that each of the cells is positioned adjacent a side opening of at least one other of cells, to permit water to flow laterally through the side opening from either of the adjacent cells to the other adjacent cell;

when each top leg lower end portion is so inserted into and horizontally positioned within the respective bottom leg cavity such that the at least one spacer is sandwiched between the top leg lower end surface and the bottom leg recessed end surface, at least partially filing each cavity with a flowable substance; and causing the flowable substance to harden, to seat the inserted and horizontally positioned top leg lower end portion in the cavity.

18. The method of constructing a water management system according to claim 17, further comprising:

before positioning a cell top module on each cell bottom module, mounting an alignment guide on the bottom leg, the alignment guide comprising a peripheral collar, the peripheral collar extending around and engaging an outer peripheral surface of the bottom leg to support the alignment guide when the alignment guide is mounted on the bottom leg, the alignment guide comprising at least one guide member operatively connected to and tapering upwardly and outwardly from the peripheral collar, an upper end of the at least one guide member defining an insertion area configured for insertion of an outer peripheral portion of the top leg downwardly therethrough, the alignment guide being adapted and configured such that, when the alignment guide is mounted on the bottom leg, the insertion area is spaced above the open top of the bottom leg cavity, such that when the top leg is positioned above and axially aligned with the bottom leg, the outer peripheral portion of the top leg fits in the insertion area with a clearance greater than the clearance between the inner surface of the bottom leg sidewall and the outer peripheral surface of the top leg lower end portion in the centered position, and when the outer peripheral portion of the top leg meets the insertion area, the top leg end surface is above an elevation of the open top of the bottom leg cavity, and such that when the top leg is suspended above the bottom leg with freedom of lateral movement, inserted into the alignment guide in a position in which the top leg lower end portion is laterally out of insertion alignment with the bottom leg cavity, and passively lowered toward the bottom leg, the at least one guide member engages the outer peripheral portion of the top leg to cam the top leg towards axial alignment with the bottom leg, so that the top leg end surface is guided within an area of the open top of the bottom leg cavity when reaching an elevation at or above that of the open top of the bottom leg cavity and held within the area of the open top of the bottom leg cavity when passively lowered for insertion therethrough.

19. The method of constructing a water management system according to claim 18, wherein the alignment guide peripheral collar comprises at least two members configured to be at least partially disengageable from each other to open the peripheral collar, further comprising at least partially disengaging the peripheral collar members to open the peripheral collar, and laterally removing the alignment guide from the bottom leg after the top leg is placed thereon.

20. A method of constructing a water management system adapted to be deployed below ground, comprising a plurality of cells, a plurality of wall panels, and at least one tension cable, each cell having a top flange and a base, a perimeter of the top flange being vertically aligned with a like perimeter of the base, the top flange having at least a first tension cable channel extending therethrough between two spaced apart open channel ends, each of the two open channel ends being disposed at the top flange perimeter, each cell having side openings, the side openings comprised in a peripheral cell area extending vertically from the base perimeter to the top flange perimeter, each cell having a support structure extending from the top flange to the base and surrounded by the peripheral cell area, and the plurality of wall panels collectively comprising, for each of the tension cables, a pair of attachment features for attaching each end of the tension cable to one of a pair of the wall panels, the method comprising:

positioning the cells in a horizontal array such that a side opening of each of the cells is positioned adjacent a side opening of at least one other adjacent cell, to permit water to flow laterally through the adjacent side openings from either of the adjacent cells to the other adjacent cell, such that the cell top flanges form a continuous top deck having a top deck perimeter, such that the cell bases form a continuous bottom deck having a bottom deck perimeter, and such that at least one first tension cable path is formed by a series of the first tension cable channels of a corresponding series of the cell top flanges, each first tension cable path extending through the top deck and having two spaced apart open path ends disposed at the top deck perimeter;

positioning the plurality of wall panels to form a continuous wall around the top deck perimeter and the bottom deck perimeter, so that the system sidewall, the top deck, and the bottom deck cooperate to enclose a system volume that is above the bottom deck, below the top deck, and peripherally surrounded by the system sidewall;

positioning a tension cable so as to extend through each first tension cable path;

engaging an attachment feature of a respective wall panel adjacent each open path end of the first tension cable path to attach a respective end of the first tension cable to the respective wall panel; and imparting tension to the tension cable to press between the respective wall panels the series of cell top flanges corresponding to the first tension cable path.

* * * * *